United States Patent [19]

Yagihara et al.

[11] 4,264,722

[45] Apr. 28, 1981

[54] SILVER HALIDE PHOTOGRAPHIC LIGHT-SENSITIVE MATERIAL

[75] Inventors: Morio Yagihara; Yukio Yokota, both of Minami-ashigara

[73] Assignee: Fuji Photo Film Co., Ltd., Minami-ashigara, Japan

[21] Appl. No.: 93,965

[22] Filed: Nov. 14, 1979

[30] Foreign Application Priority Data

Nov. 14, 1978 [JP] Japan ..... 53-140098

[51] Int. Cl.[3] .....G03C 1/40

[52] U.S. Cl. ..... 430/551; 430/553

[58] Field of Search ..... 430/553, 385, 472, 551

[56] References Cited

U.S. PATENT DOCUMENTS

| | | | |
|---|---|---|---|
| 2,476,008 | 7/1949 | Vittum et al. | 430/385 |
| 3,476,563 | 11/1969 | Loria | 430/553 |
| 4,134,766 | 1/1979 | Kikuchi et al. | 430/553 |

FOREIGN PATENT DOCUMENTS

| | | | |
|---|---|---|---|
| 2615402 | 10/1976 | Fed. Rep. of Germany | 430/553 |

*Primary Examiner*—Travis Brown

*Attorney, Agent, or Firm*—Sughrue, Rothwell, Mion, Zinn and Macpeak

[57] ABSTRACT

A silver halide photographic light-sensitive material containing a colorless photographic cyan color-forming coupler having, in a position for coupling with an oxidation product of an aromatic primary amine developing agent, an eliminatable group represented by the following formula (I):

$$-O-(R_1O)_x(R_2O)_yR_3 \quad (I)$$

wherein $R_1$ and $R_2$ each represents a substituted or unsubstituted alkylene group which may be branched provided that $R_1$ is not substituted with an aryl group at the carbon atom adjacent to the oxygen atom bonded to the coupling position, $R_3$ represents a hydrogen atom, a substituted or unsubstituted alkyl group, a cycloalkyl group, an aryl group, or a cyan coupler residue, x represents a positive integer, and y represents 0 or a positive integer.

21 Claims, No Drawings

SILVER HALIDE PHOTOGRAPHIC LIGHT-SENSITIVE MATERIAL

BACKGROUND OF THE INVENTION

1. Field of the Invention

This invention relates to a photographic color coupler and, more particularly, to a novel 2-equivalent cyan coupler, color photographic light-sensitive material containing that coupler, and image-forming process using the couplers.

2. Description of the Prior Art

It is well known that when an imagewise exposed silver halide photographic light-sensitive material is subjected to color development processing, an oxidation product of the aromatic primary amine developing agent reacts with a dye-forming coupler to form a color image.

Usually, a color-reproducing process based on subtractive color photography is relied upon forming cyan, magenta, and yellow color images, the colors of which are in complementary relation with red, green, and blue, respectively. For example, phenolic derivatives or naphtholic derivatives used as couplers for forming cyan color images.

In color photography, color-forming couplers are added to a developer or incorporated in a light-sensitive photographic emulsion layer or other color image-forming layer and, when reacted with an oxidation product of a color-developing agent formed upon development, they form non-diffusing dyes. The reaction between the coupler and the color-developing agent proceeds at the active site of the coupler. Couplers having a hydrogen atom at this active site are 4-equivalent couplers which theoretically require 4 mols of silver halide with a developing center (exposed silver halide) as an oxidizing agent for forming 1 mol of a dye. On the other hand, couplers having at the active site a group capable of being eliminated as an anion are 2-equivalent couplers which require only two mols of silver halide with a developing center and, therefore, they generally permit a reduction in the amount of silver halide incorporated in a light-sensitive layer and in the thickness of the film, thus enabling one to shorten the time for processing light-sensitive materials and improving sharpness of color images to be formed. As such eliminatable or coupling-off group, U.S. Pat. No. 3,737,316 describes a sulfonamido group, U.S. Pat. No. 3,749,735 describes an imido group, U.S. Pat. No. 3,622,328 describes a sulfonyl group, U.S. Pat. No. 3,476,563 describes an aryloxy group, U.S. Pat. No. 3,311,476 describes an acyloxy group, and U.S. Pat. No. 3,214,437 describes a thiocyano group.

Further, U.S. Pat. No. 4,032,345 describes an isocyanato group, U.S. Pat. No. 4,046,573 describes a sulfonyloxy group, Japanese Patent Application (OPI) No. 51939/77 (The term "OPI" as used herein refers to a "published unexamined Japanese patent application") describes a thiocarbonyloxy group, Japanese Patent Application (OPI) Nos. 39126/78 and 39745/78 describe an aralkenylcarbonyloxy group, Japanese Patent Application (OPI) No. 45524/78 describes an S-substituted monothiocarbonyloxy group, Japanese Patent Application (OPI) No. 47827/78 describes a propioloyloxy group, U.S. Pat. No. 4,072,525 describes a group of

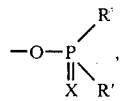

and U.S. Pat. No. 3,227,551, Japanese Patent Application (OPI) Nos. 120334/75, 18315/77, 90932/77, 52423/78 and 99938/78 describe substituted alkoxy groups.

Proper selection of such eliminatable groups, for example, selection of a group having a diffusible dye moiety, permits the use of the couplers in a diffusion transfer process where images of diffusible dyes are formed in an image-receiving layer. Such couplers are called diffusible dye-releasing (DDR) couplers and are described in, for example, U.S. Pat. Nos. 3,227,550, U.S. Pat. No. 4,052,212 3,765,886, U.S. Defensive Publication No. T 900,029, British Pat. No. 1,330,524, etc. Some colored 2-equivalent couplers have the masking effect for color correction of a dye image, and such couplers are called color correction couplers described in, for example, Japanese Patent Application (OPI) No. 26034/76.

2-Equivalent couplers from which a development inhibiting product is eliminated are so-called development inhibitor-releasing couplers, which inhibit development in proportion to the amount of silver deposit, thus contributing to reduction in image-forming particle size, adjustment of gradation, and improvement of color reproduction. In addition, they can be used in a diffusion transfer process utilizing their action on an adjacent layer. These couplers are described in U.S. Pat. No. 3,227,554, Japanese Patent Application (OPI) No. 122335/74, and West German Patent Application (OLS) No. 2,414,006.

2-Equivalent couplers have important advantage over 4-equivalent couplers as described above and permit various applications, thus they are often used. However, many conventionally known 2-equivalent cyan-forming couplers have the defects of insufficient coupling reactivity, serious color fog, coating troubles due to poor dispersibility, poor storage stability, and poor color image stability.

SUMMARY OF THE INVENTION

An object of the present invention is, therefore, to provide novel 2-equivalent cyan-forming couplers which overcome the defects described above and which have an excellent coloring property.

Another object of the present invention is to provide a process for forming a cyan color image by developing a silver halide emulsion in the presence of a novel 2-equivalent coupler.

A further object of the present invention is to provide a silver halide color photographic light-sensitive material containing a novel 2-equivalent coupler and a process for forming images using that light-sensitive material.

As a result of various investigations, it has been discovered that the above-described objects can effectively be attained using a colorless photographic cyan color-forming coupler having an eliminatable group represented by the following general formula (I) at the coupling position with an oxidation product of an aromatic primary amine developing agent.

$$-O-(R_1O)_x(R_2O)_yR_3 \qquad (I)$$

The group represented by the formula (I) is eliminated upon formation of a dye by a coupling reaction. In the formula, $R_1$ and $R_2$ each represents a substituted or unsubstituted alkylene group, which may be branched provided $R_1$ is not substituted with an aryl group at the carbon atom adjacent to the oxygen atom bonded to the coupling position.

$R_3$ represents a hydrogen atom, a substituted or unsubstituted alkyl group, a substituted or unsubstituted cycloalkyl group, an aryl group, or a cyan coupler residue.

x represents a positive integer, and y represents 0 or a positive integer.

DETAILED DESCRIPTION OF THE INVENTION

The term "colorless coupler" as used herein means a coupler having a molecular extinction coefficient of not more than 5,000 at its maximum absorption wavelength in the visible light region.

The colorless 2-equivalent cyan color-forming couplers of the present invention show a faster dye-forming rate due to the coupling off group as compared with conventional couplers have an alkoxy group at the active position, and hence they provide higher sensitivity, higher gradation, and higher maximum density. Thus, they permit a reduction in the amount of silver halide incorporated in a photographic emulsion, and are suitable for not only ordinary processing but rapid processing as well. Further, they do not cause fogging, color stain, etc., of a light-sensitive layer, and they show such good dispersibility in photographic layers such as a light-sensitive layer that they can be dispersed therein in a high concentration. Dyes to be obtained from such cyan couplers show excellent durability against light, heat, and humidity and show such good light absorption characteristics that they do not have unnecessary absorptions and that they show sharp absorptions. In addition, they have the advantage that they are useful for forming images in a so-called conventional system.

Further, as will be stated in Examples to be described hereinafter, the couplers of the present invention show extremely excellent coloring properties as compared with other couplers described in Japanese Patent Application (OPI) No. 99938/78.

Specific examples of the preferred couplers of the present invention are couplers represented by the following general formula (IA):

$$A\text{-}[O\text{-}(R_1O)_x(R_2O)_yR_3]_n \qquad \text{(IA)}$$

where A represents a cyan color-forming coupler residue having a naphtholic or phenolic nucleus, and $R_1$ and $R_2$ each represents an alkylene group containing 1 to 6 carbon atoms (for example, a methylene group, a dimethylene group, a trimethylene group, a 2-methyldimethylene group, a 2-methyltrimethylene group, a propylene group, etc.), which may be branched and may bear a substituent, provided that $R_1$ is not substituted with an aryl group at the carbon atom adjacent the oxygen atom bonded to the coupling position. Suitable substituents for $R_1$ and $R_2$ include a nitro group, a hydroxy group, a sulfo group, an alkoxy group containing 1 to 4 carbon atoms (e.g., a methoxy group, an ethoxy group, etc.), which may be straight chain, branched chain or cyclic, an aliphatic acyloxy group containing 1 to 4 carbon atoms or an aromatic acyloxy group containing 6 to 12 carbon atoms (e.g., an acetoxy group, etc.), a mono- or bicyclic aryl group containing 6 to 12 carbon atoms (e.g., a phenyl group, a naphthyl group, etc.), and the like.

$R_3$ represents a hydrogen atom, a straight chain or branched chain alkyl group containing 1 to 18 carbon atoms, a cyclopentyl or cyclohexyl group, a mono- or bicyclic aryl group containing 6 to 12 carbon atoms, or a cyan coupler residue. Each of the alkyl group, cycloalkyl group, and aryl group represented by $R_3$ may be substituted by, for example, a halogen atom (fluorine, chlorine, or bromine), a cyano group, a hydroxy group, a straight chain, branched chain or cyclic alkoxy group containing 1 to 18 carbon atoms, an aliphatic acyloxy group containing 1 to 4 carbon atoms or an aromatic acyloxy group containing 6 to 12 carbon atoms, an aliphatic acylamino group containing 1 to 4 carbon atoms or an aromatic acylamino group containing 6 to 12 carbon atoms, a sulfonamido group, a sulfamoyl group, a sulfonyl group, a carboxy group, a sulfo group, etc. The alkyl group represented by $R_3$ may be straight or branched.

x and y in the general formula (IA) each represents an integer of 1 to 10, and y may be 0.

n represents a positive integer. n preferably represents 1 or 2, but, in the case of using as a mother moiety a cyan coupler known as polymer coupler, n may be 3 or more.

In the aforesaid general formula (IA), the cyan coupler residue is a residue of cyan coupler from which a hydrogen atom or an eliminatable group in the active site of a cyan coupler is removed and, where a plural number of active sites exist in the same molecule, the eliminatable groups introduced at the respective active sites may be the same or different, or a hydrogen atom may be introduced. Preferably, however, all active sites have the eliminatable group of the present invention.

Of the couplers of the present invention, particularly useful are those represented by the following general formula (IIA) or (IIB):

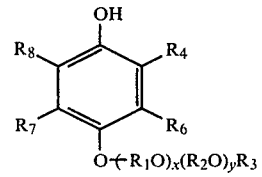

(IIA)

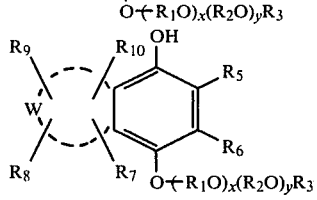

(IIB)

In the above formulae, $R_1$, $R_2$, $R_3$, x and y are the same as defined for the general formula (IA). $R_4$ represents a hydrogen atom, an aliphatic group containing up to 30 carbon atoms (for example, an alkyl group such as a methyl group, an isopropyl group, a pentadecyl group, an eicosyl group, or the like), an alkoxy group containing up to 30 carbon atoms (for example, a methoxy group, an isopropoxy group, a pentadecyloxy group, or the like), a mono- or bicyclic aryloxy group containing 1 to 30 carbon atoms (for example, a phenoxy group, a p-tert-butylphenoxy group, or the like), an acylamido group represented by the following general formula (III), a sulfonamido group represented by the following formula ((IV), a phosphoric acid amido group represented by the following formula (V), a ureido group represented by the following formula (VI), or a carbamoyl group represented by the following formula (VII) or (VIII):

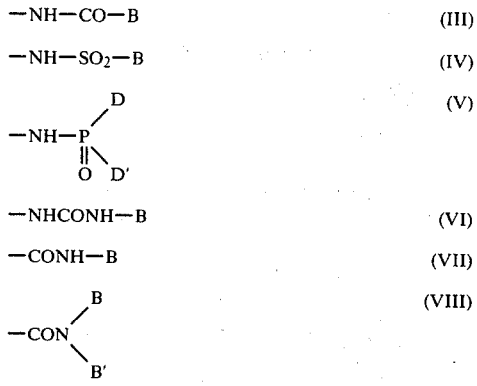

wherein B and B′ may be the same or different and each represents an aliphatic group containing 1 to 32 carbon atoms, preferably a straight or branched alkyl group containing 1 to 20 carbon atoms, a cyclic alkyl group containing 1 to 20 carbon atoms (for example, a cyclopropyl group, a cyclohexyl group, a norbornyl group, or the like), or a mono- or bicyclic aryl group containing 1 to 32 carbon atoms, preferably 1 to 20 carbon atoms (for example, a phenyl group, a naphthyl group, or the like). The abovedescribed alkyl group and aryl group may be substituted by a halogen atom (for example, fluorine, chlorine, or the like), a nitro group, a cyano group, a hydroxy group, a carboxy group, an amino group (for example, an amino group, an alkylamino group, a dialkylamino group, an anilino group, an N-alkylanilino group, or the like), an alkyl group (for example, those described hereinbefore), an aryl group (for example, a phenyl group, an acetylaminophenyl group, or the like), an alkoxycarbonyl group (for example, a tetradecyloxycarbonyl group, or the like), an acyloxycarbonyl group, an amido group (for example, an acetamido group, a methanesulfonamido group, or the like), an imido group (for example, a succinimido group, or the like), a carbamoyl group (for example, an N,N-dihexylcarbamoyl group, or the like), a sulfamoyl group (for example, an N,N-diethylsulfamoyl group, or the like), an alkoxy group (for example, an ethoxy group, a tetradecyloxy group, an octadecyloxy group, or the like), an aryloxy group (for example, a phenoxy group, a p-tert-butylphenoxy group, a 2,4-di-amylphenoxy group, a 4-hydroxy-3-tert-butylphenoxy group, or the like), etc.

D and D′ each represents B described above or one of —OB, —NHB, and —$NB_2$.

$R_5$ is selected from among a hydrogen atom, an aliphatic group containing up to 30 carbon atoms (particularly, an alkyl group containing 1 to 20 carbon atoms), and a carbamoyl group represented by the general formula (VII) or (VIII).

$R_6$, $R_7$, $R_8$, $R_9$, and $R_{10}$ each represents a hydrogen atom, a halogen atom, an alkyl group, a mono- or bicyclic aryl group containing 6 to 20 carbon atoms, an alkoxy group containing 1 to 20 carbon atoms, an alkylthio group containing 1 to 20 carbon atoms, a heterocyclic group, an amino group including alkyl- and arylamino groups, a carbonamido group, a sulfonamido group, a sulfamyl group, or a carbamyl group. The aforementioned heterocyclic group may be a 5- or 6-membered, saturated or unsaturated ring, which may contain one or more hetero atoms such as an oxygen atom, a sulfur atom and/or a nitrogen atom in addition to the nitrogen atom in the formula and which may be condensed with other aromatic ring. For example, $R_6$ represents one of the following groups: a halogen atom (for example, a chlorine atom, a bromine atom, or the like), a primary, secondary, or tertiary alkyl group containing 1 to 22 carbon atoms (for example, a methyl group, a propyl group, an isopropyl group, an n-butyl group, a sec-butyl group, a tert-butyl group, a hexyl group, a dodecyl group, a 2-chlorobutyl group, a 2-hydroxyethyl group, a 2-phenylethyl group, a 2-(2,4,6-trichlorophenyl)ethyl group, a 2-aminoethyl group, or the like), an alkylthio group (for example, a hexadecylthio group, or the like), an aryl group (for example, a phenyl group, a 4-methylphenyl group, a 2,4,6-trichlorophenyl group, a 3,5-dibromophenyl group, a 4-trifluoromethylphenyl group, a 2-trifluoromethylphenyl group, a 3-trifluoromethylphenyl group, a naphthyl group, a 2-chloronaphthyl group, a 3-ethylnaphthyl group, or the like), a heterocyclic ring group (for example, a benzofuranyl group, a furanyl group, a thiazolyl group, a benzothiazolyl group, a naphthothiazolyl group, an oxazolyl group, a benzoxazolyl group, a naphthoxazolyl group, a pyridyl group, a quinolinyl group, or the like), an amino group [for example, an alkylamino group containing 1 to 20 carbon atoms (e.g., a methylamino group, a diethylamino group, a dodecylamino group), an arylamino group containing 6 to 20 carbon atoms (e.g., a phenylamino group, a tolylamino group, a 4-(3-sulfobenzamido)anilino group, a 4-cyanophenylamino group, a 2-trifluoromethylphenylamino group, a benzothiazolamino group), or the like], a carbonamido group [for example, an alkylcarbonamido group, the alkyl moiety of which contains 1 to 20 carbon atoms (e.g., an ethylcarbonamido group, a decylcarbonamido group, etc.); an arylcarbonamido group the aryl moiety of which contains 6 to 20 carbon atoms (e.g., a phenylcarbonamido group, a 2,4,6-trichlorophenylcarbonamido group, a 4-methylphenylcarbonamido group, a 2-ethoxyphenylcarbonamido group, a 3-[α-(2,4-di-tert-amylphenoxy)acetamido]benzamido group, a naphthylcarbonamido group, etc.); a 5- or 6-membered heterocyclic ring carbonamido group which may contain one or more hetero atoms such as a nitrogen atom, an oxygen atom or a sulfur atom (e.g., a thiazolylcarbonamido group, a benzothiazolylcarbonamido group, a naphthothiazolylcarbonamido group, an oxazolylcarbonamido group, a benzoxazolylcarbonamido group, an imidazolylcarbonamido group, a benzimidazolylcarbonamido group, etc.), or the like], a sulfonamido group [for example, an alkylsulfonamido group, the alkyl moiety of which contains 1 to 20 carbon atoms (e.g., a butylsulfonamido group, a dodecylsulfonamido group, a phenylethylsulfonamido group, etc.); an arylsulfonamido group, the aryl moiety of which contains 6 to 20 carbon atoms (e.g., a phenylsulfonamido group, a 2,4,6-trichlorophenylsulfonamido group, a 2-methoxyphenylsulfonamido group, a 3-carboxyphenylsulfonamido group, a naphthylsulfonamido group, etc.); or a 5- or 6-membered heterocyclic ring sulfonamido group which may contain one or more hetero atoms such as nitrogen atom, an oxygen atom or a sulfur atom (e.g., a thiazolylsulfonamido group, a benzothiazolylsulfonamido group, an imidazolylsulfonamido group, a benzimidazolylsulfonamido group, a pyridylsulfonamido group, etc.)], a sulfamyl group [for example, an alkylsulfamyl group, the alkyl moiety of which contains 1 to 20 carbon atoms (e.g., a propylsulfamyl group, an octylsulfamyl group, a pentadecylsulfamyl group, an octadecylsulfamyl group, etc.); an arylsulfamyl group, the aryl moiety of which contains 6 to 20 carbon atoms (e.g., a phenylsulfamyl group, a 2,4,6-trichlorophenylsulfamyl group, a 2-methoxyphenylsulfamyl group, a naphthylsulfamyl group. etc.); a 5- or 6-membered heterocyclic ring sulfamyl group which may contain one or more hetero atoms such as a nitrogen atom, an oxygen atom or a sulfur atom (e.g., a thiazolylsulfamyl group, a benzothiazolylsulfamyl group, an oxazolylsulfamyl group, a benzimidazolylsulfamyl group, a pyridylsulfamyl group, etc.); or the like], and a carbamyl group [for example, an alkylcarbamyl group, the alkyl moiety of which contains 1 to 20 carbon atoms (e.g., an ethylcarbamyl group, an octylcarbamyl group, a pentadecylcarbamyl group, an octadecylcarbamyl group, etc.); an arylcarbamyl group, the aryl moiety of which contains 6 to 20 carbon atoms (e.g., a phenylcarbamyl group, a 2,4,6-trichlorophenylcarbamyl group, etc.); a 5- or 6-membered heterocyclic ring carbamyl group which may contain one or more hetero atoms such as a nitrogen atom, an oxygen atom or a sulfur atom (e.g., a thiazolylcarbamyl group, a benzothiazolylcarbamyl group, an oxazolylcarbamyl group, an imidazolylcarbamyl group, a benzimidazolylcarbamyl group, etc.); or the like]. As the examples of $R_7$, $R_8$, $R_9$, and $R_{10}$, those illustrated for $R_6$ can be used. W represents non-metallic atoms necessary to form 5- and/or 6-membered ring such as a benzene ring, a cyclohexene ring, a cyclopentene ring, a thiazole ring, an oxazole ring, an imidazole ring, a pyridine ring, a pyrrole ring, etc., with a benzene ring being preferred.

In the foregoing general formulae (IIA) and (IIB), particularly useful compounds are those wherein $R_1$ and $R_2$ each represents an alkylene group containing 1 to 4 carbon atoms, $R_3$ represents a hydrogen atom or a carboxy-substituted alkyl group (containing 1 to 6 carbon atoms), x represents an integer of 1 to 4, and y represents 0 or an integer of 1 to 4. Compounds wherein x+y is 2 to 8 are particularly preferred.

Typical examples of the couplers of the present invention will be illustrated below.

(1)

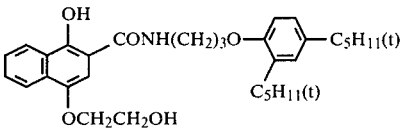

(2)

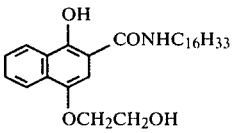

(3)

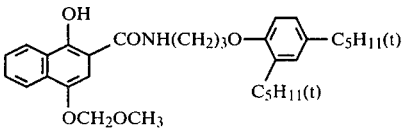

-continued (4)

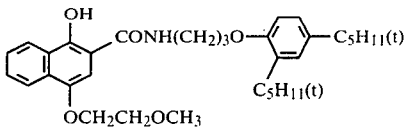

(5)

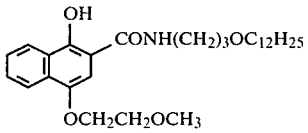

(6)

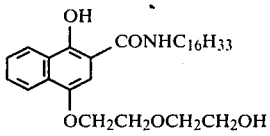

(7)

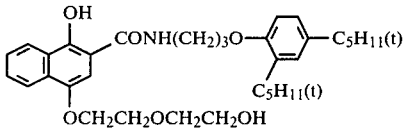

(8)

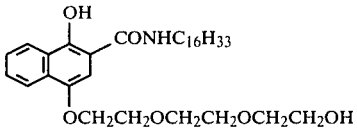

(9)

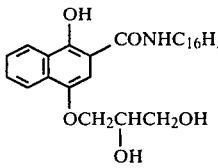

(10)

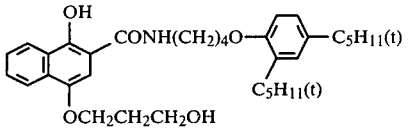

(11)

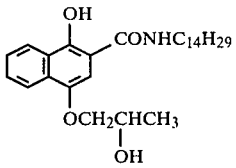

(12)

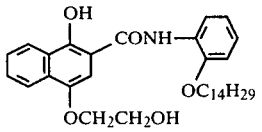

(13)

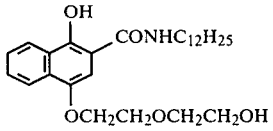

(14)

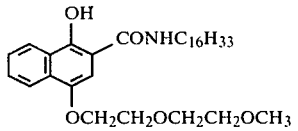

(15)

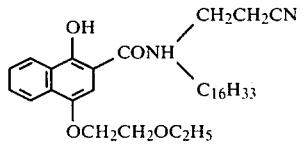

-continued
(16)
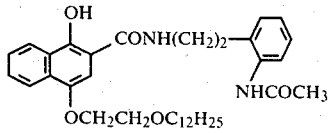
(17)
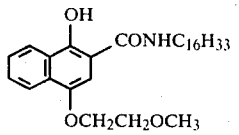
(18)
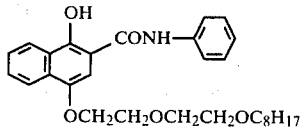
(19)
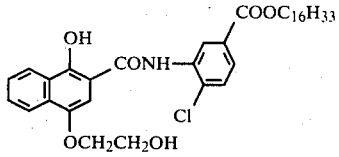
(20)
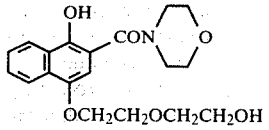
(21)
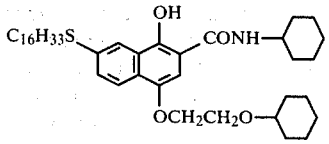
(22)
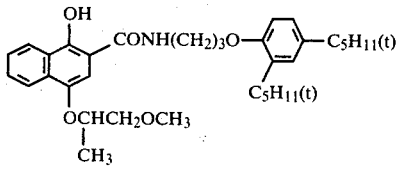
(23)
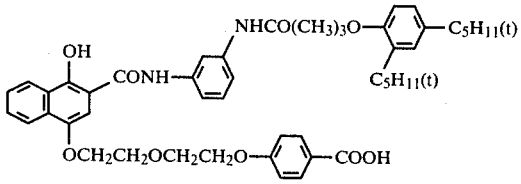
(24)
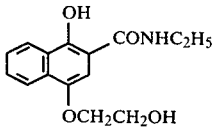
(25)
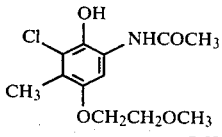
(26)
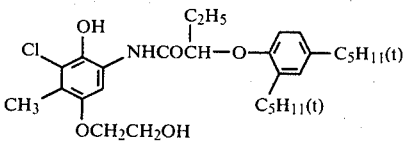
(27)
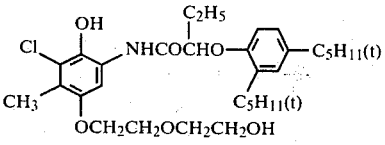
-continued
(28)
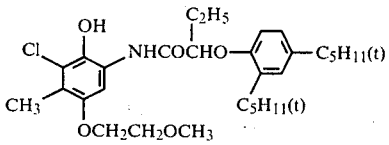
(29)
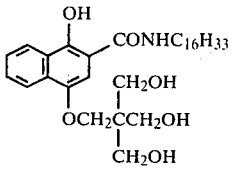
(30)
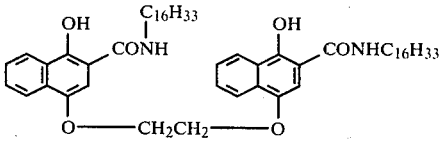
(31)
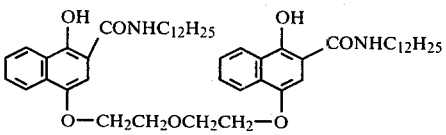
(32)
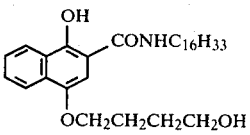
(33)
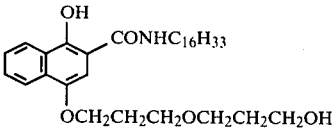
(34)
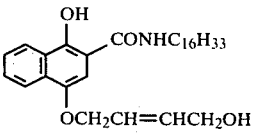
(35)
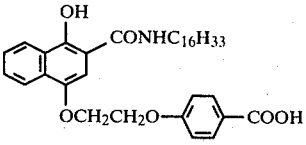
(36)
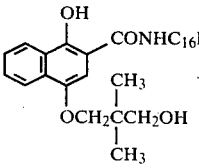
(37)
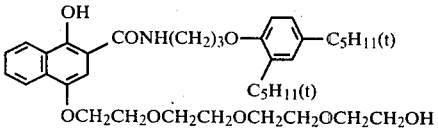
(38)
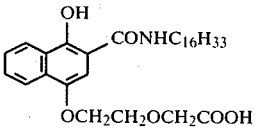
(39)
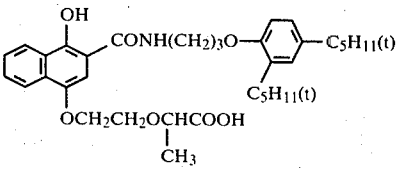

-continued (40)

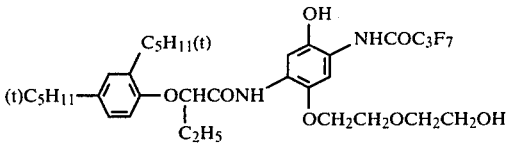

(41)

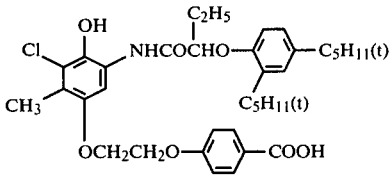

(42)

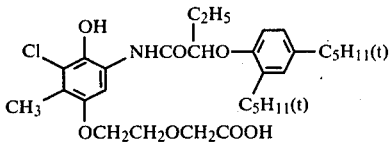

(43)

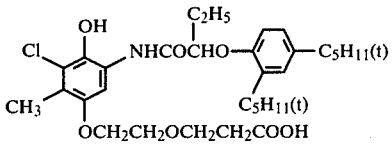

(44)

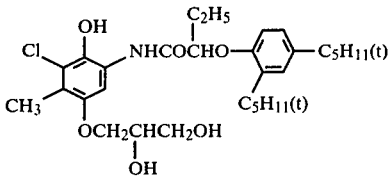

(45)

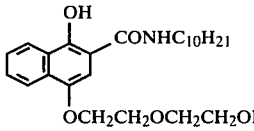

These compounds of the present invention can be synthesized according to the following processes.

With regard to naphtholic compounds, corresponding couplers can be synthesized by reacting 1,4-dihydroxy-2-naphtholic acid which can be synthesized in the manner described in, for example, Russig, F., J. Prakt. Chem. (2), 62, 33, (1900), J. Ameri. Chem. Soc., 64, 798 (1942) with an alkyl halide substituted by a hydroxy group, an alkoxy group, etc. The alkyl halide is used in an amount of about 2 to about 5 mols per mol of 1,4-dihydroxy-2-naphtholic acid. The reaction is carried out in a solvent such as acetone, dimethylformamide, water, methanol, etc., the amount of which is about 5 ml per g of 1,4-dihydroxy-2-naphtholic acid, in the presence of pyridine, sodium carbonate, sodium hydroxide, a sodium alkoxide, etc., at a temperature of about 35° to about 60° C. at pH of more than 10 in a nitrogen atmosphere. Alternatively, 1,4-dihydroxy-2-naphtholic acid is reacted with a substituted alcohol in an amount of about 10 to about 20 mols per mol of 1,4-dihydroxy-2-naphtholic acid, in a solvent such as toluene, anisole, xylene, etc., (5 ml per g of 1,4-dihydroxy-2-naphtholic acid), in the presence of an acid catalyst such as sulfuric acid, p-toluenesulfonic acid, methanesulfonic acid, etc., (0.6 to about 1.0 mol per mol of 1,4-dihydroxy-2-naphtholic acid) at a temperature of about 100° to about 130° C. The resulting 1-hydroxy-4-substituted alkoxy-2-naphtholic acid derivative is converted to an acid chloride in accordance with, for example, Org. Synth., Coll. Vol. 1, 12 (1932), Helu., 42, 1652 (1959); or a phenyl ester derivative by reaction with phenols such as phenol, m-cresol, p-nitrophenol, etc., in the presence of chlorination agents such as thionyl chloride, a phosphorus oxychloride, etc., in the presence of a catalyst such as dimethylformamide, dimethylacetamide, etc., in accordance with, for example, Org. Synth., Coll. Vol. 4, 390, 178 (1963), Chem. Ind., 2102 (1964). The acid chloride or phenyl ester is then condensed with a corresponding amine such as aniline, 2,4-di-tert-amylphenoxypropylamine, etc.

With regard to phenolic couplers, corresponding couplers can be synthesized as follows. The hydroxy group at the 1-position of a 1,4-diphenylbenzene derivative is protected by, for example, pyranyl esterification as described in H. N. Grant, V. Prolog and R. P. A. Sneedon, Helv. Chem. Acta., 46 415 (1963) or an oxazole ring is previously formed from the hydroxy group at the 1-position and an acetylamino group at the 2-position according to Japanese Patent Application No. 69572/76 and Japanese Patent Application (OPI) No. 153923/77. The resulting hydroxy-protected compound is reacted with a corresponding substituted alkyl halide in an amount of about 1 to about 2 mols per mol of the oxazole ring compound or the pyranyl ether compound, in the presence of a base such as potassium carbonate, sodium hydroxide, potassium hydroxide, sodium methoxide, sodium ethoxide, pyridine, trimethylamine, etc., (about 3 to about 5 mols per mol of the oxazole ring compound or the pyranyl ether compound) to alkylate the hydroxy group at the 4-position. The oxazole ring is then cleaved with hydrochloric acid (conc.) at temperature of about 80° to about 85° C. and the resulting product is reacting with equimolecular quantities of a corresponding acid chloride in the presence of a dehydrochlorination agent such as pyridine, quinoline, trimethylamine, etc., to form the corresponding coupler.

In addition, both naphtholic and phenolic couplers can be synthesized by reacting a 1,4-dihydroxyaryl derivative represented by the following general formula (IX) or (X) with a corresponding alkyl halide or alcohol under the aforesaid conditions.

(IX)

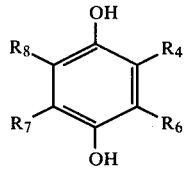

(X)

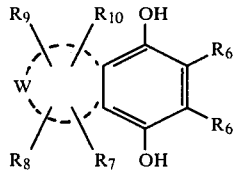

In the above formulae, $R_4$, $R_5$, $R_6$, $R_7$, $R_8$, $R_9$, $R_{10}$ and W are the same as defined for the general formulae (IIA) and (IIB).

Typical examples of synthesizing the couplers of the present invention will specifically be described below.

SYNTHESIS EXAMPLE 1

Synthesis of 1-hydroxy-4-(β-methoxyethoxy)-N-[γ-(2,4-ditert-amylphenoxy)propyl]-2-naphthamide (Coupler (4))

82 g (0.4 mol) of 1,4-dihydroxy-2-naphtholic acid and 76 g (0.4 mol) of p-toluenesulfonic acid were added to 800 ml of dehydrated toluene and, under heating to 95° C. and stirring, 76 g (0.8 mol) of β-methoxyethanol was added thereto. After stirring for 5 hours under heating, the mixture was cooled to 20° to 30° C. A solid precipitate thus-formed was collected by filtration to obtain 46.7 g (45%) of 1-hydroxy-4-(β-methoxyethoxy)-2-naphtholic acid. 46 g (0.175 mol) of the thus-obtained naphtholic acid, 29 g (0.21 mol) of p-nitrophenol, and 1 ml of dimethylformamide were added to 300 ml of acetonitrile and, under heating and stirring, 31 g (0.26 mol) of thionyl chloride was dropwise added thereto. After heating and stirring for 3 hours, the reaction mixture was cooled, and the crystals thus-formed were collected by filtration to obtain 47.4 g (71%) of 1-hydroxy-4-(β-methoxyethoxy)-2-naphtholic acid p-nitrophenyl ester.

Then, 15.3 g (0.04 mol) of the thus-obtained p-nitrophenyl ester was reacted with 12.8 g (0.044 mol) of N-(γ-2,4-di-tert-amylphenoxy)propylamine in 150 ml of acetonitrile under heating and stirring and, after stirring for 2 hours, acetonitrile was distilled off under reduced pressure. Purification by silica gel column chromatography yielded 18.2 g (85%) of coupler (4). Recrystallization was conducted from hexane. m.p.: 99° to 101° C.

Elemental Analysis for $C_{33}H_{45}NO_5$: Calc'd: C: 73.98, H: 8.47, N: 2.61. Found: C: 73.98, H: 8.55, N: 2.83.

SYNTHESIS EXAMPLE 2

Synthesis of 1-hydroxy-4-(β-hydroxyethoxy)-N-n-hexadecyl-2-naphthamide (Coupler (2))

10 g of (0.023 mol) of 1,4-dihydroxy-N-n-hexadecyl-2-naphthamide and 4.4 g (0.023 mol) of p-toluenesulfonic acid were added to 50 ml of ethylene glycol and, after heating and stirring for 5 hours, 100 ml of water was added thereto followed by collecting thus-formed crystals by filtration. Recrystallization from methanol yielded 7.9 g (73%) of coupler (2). m.p.: 84° to 85° C.

Elemental Analysis for $C_{29}H_{45}NO_4$: Calc'd: C: 73.84, H: 9.62, N: 2.97. Found: C: 73.81, H: 9.67, N: 3.06.

SYNTHESIS EXAMPLE 3

Synthesis of 1-hydroxy-4-[β-(β'-hydroxyethoxy)ethoxy]-N-n-hexadecyl-2-naphthamide (Coupler (6))

10 g (0.023 mol) of 1,4-dihydroxy-N-n-hexadecyl-2-naphthamide and 4.4 g (0.023 mol) of p-toluenesulfonic acid were added to 100 ml of diethylene glycol and, after heating and stirring for 5 hours, the reaction mixture was cooled to 20° to 30° C. followed by adding thereto 100 ml of water. Crystals thus-formed were collected by filtration. Recrystallization from n-hexane yielded 8.1 g (68%) of coupler (6). m.p.: 60° to 61° C.

Elemental Analysis for $C_{31}H_{49}NO_5$: Calc'd: C: 72.19, H: 9.78, N: 2.72. Found: C: 72.06, H: 9.60, N: 2.63.

In the production of silver halide photographic light-sensitive materials using the couplers of the present invention, the couplers may be used alone or in combinations of two or more. Color photographic light-sensitive materials containing the coupler or couplers of the present invention may contain the following couplers. For example, cyan dye-forming couplers described in U.S. Pat. Nos. 2,474,293, 3,034,892, 3,592,383, 3,311,476, 3,476,563, etc.; couplers capable of releasing a development-inhibiting compound upon color reaction (so-called DIR couplers and DIR compounds) (described in, for example, U.S. Pat. Nos. 3,632,345, 3,227,554, 3,379,529, etc.), yellow dye-forming couplers (described in, for example, West German Patent Application (OLS) No. 2,213,461, U.S. Pat. No. 3,510,306, etc.), and magenta dye-forming couplers (described in, for example, U.S. Pat. No. 3,615,506, Japanese Patent Application No. 56050/73, and West German Patent Application (OLS) No. 2,418,959) can be used.

The above-described couplers and the like can be used in combinations of two or more in the same layer to obtain characteristics required for light-sensitive materials. It is of course possible to add the same compound to two or more different layers.

Suitable silver halide emulsions which can be used in the present invention include those containing silver chloride and silver bromide as well as mixed halides of silver such as silver chlorobromide, silver iodobromide, silver chloroiodobromide, etc.

The silver halide grains of these emulsions may be of a cubic form, an octahedral form, or may have a mixed crystalline structure.

The silver halide grain size distribution may be narrow or broad, and is not particularly limited. Suitable methods of preparing the silver halide emulsion which can be used include those well known in the art such as the single and double jet process, the controlled double jet process, etc.

Two or more types of silver halide emulsions which have been prepared separately using different processes can be employed. The grain structure of the silver halide may be uniform or different from the surface to the interior, or may be of the so-called "conversion" type as described in British Pat. No. 635,841 and U.S. Pat. No. 3,622,318.

Further, silver halide grains which provide latent images primarily at the surface thereof or in the interior can be employed in the present invention.

The silver halide emulsions used in this invention may be chemically sensitized using well-known chemical sensitizers including N,N,N'-trimethylthiourea, the complex salts of monovalent gold such as the thiocyanates or the thiosulfates, etc., stannous chloride, hexamethylenetetramine, etc.

The layers of the photographic material can be coated using any known coating method including dip coating, air-knife coating, curtain coating, extrusion coating using a hopper as described in U.S. Pat. No. 2,681,294 and using a simultaneous multilayer coating as set forth in U.S. Pat. Nos. 2,761,791, 3,508,947, 2,941,898, 3,526,528, etc.

Suitable hydrophilic high molecular weight materials which can be present in the photographic coatings of the present invention include gelatin, cellulose derivatives, such as carboxymethylcellulose, hydroxyethylcellulose, etc., carbohydrate derivatives, such as starch derivatives, synthetic hydrophilic colloid materials, such as poly(vinyl alcohol), poly(N-vinylpyrrolidone), copolymers containing acrylic acid, polyacrylamide and the derivatives or partially hydrolyzed products of the above-described polymers, etc. Of these, the most representative is gelatin and gelatin is most generally used. The gelatin can be partly or completely replaced by a synthetic polymer or a gelatin derivative.

The photographic materials of the present invention may comprise photographic emulsions spectrally sensitized or supersensitized so as to be sensitive to blue, green or red light using cyanine dyes, such as cyanine, merocyanine, carbocyanine, etc., dyes, alone or as combinations thereof or in combination with styryl dyes.

Descriptions of suitable spectral sensitization techniques appear in, for example, U.S. Pat. No. 2,493,748 for the blue resion, U.S. Pat. No. 2,688,545 for the green region and U.S. Pat. No. 3,511,664 for the red resion.

The photographic emulsion containing the coupler of the present invention can contain known stabilizers or anti-fogging agents (e.g., 4-hydroxy-6-methyl-1,3,3a,7-tetrazaindene, 3-methylbenzothiazole, 1-phenyl-5-mercaptotetrazole, mercury-containing compounds, mercapto compounds, metallic salts, etc.).

A synthetic polymeric material can be mixed with the hydrophilic colloid such as gelatin in the photographic emulsion layer and other layers of the photographic color material of the present invention. A typical example of such a polymeric material is an aqueous latex of vinyl polymers as disclosed in U.S. Pat. No. 2,376,005, etc.

Formation of dye images in accordance with the present invention can be realized in various forms of light-sensitive materials. One of them is a process of forming a water-insoluble or diffusion-resistant dye image in an emulsion layer by processing a silver halide light-sensitive material with a color developer containing dissolved therein an aromatic primary amine color-developing agent and a coupler, which process is a non-incorporated type color photographic process. For example, illustrative couplers (20) and (25) are used for such process. Another one is a process of forming a water-insoluble or diffusion-resistant dye image in an emulsion layer by processing a light-sensitive material comprising a support having provided thereon a silver halide emulsion layer containing a diffusion-resistant coupler, with an alkaline developer containing an aromatic primary amine color-developing agent. For example, couplers (1), (2), (6), (8), (11), (38), etc., are used for this process.

The couplers of the present invention are preferably located in a silver halide emulsion layer. The phenolic or $\alpha$-naphtholic couplers used in the present invention are dissolved in an aqueous medium or an organic solvent, and then dispersed in the photographic emulsion.

Of the couplers of the present invention, oil-soluble, diffusion-resistant couplers used for an incorporated-in type process are first dissolved in an organic solvent, then dispersed as fine colloidal particles in a photographic emulsion for incorporation into a light-sensitive material.

In the present invention, it is most preferred to dissolve oil-soluble, diffusion-resistant couplers in an organic solvent, and add the resulting solution to a photographic emulsion, which provides the best effects of the present invention.

Oil-soluble diffusion-resistant couplers represented by the general formula (IIA) and (IIB) are those wherein one of the substituents represented by $R_1$ through $R_{10}$ represents a group having a ballast group containing a $C_8$ to $C_{30}$ hydrophilic residue which is bonded to the coupler skeletal structure directly or via an imino bond, an ether bond, a thioether bond, a carbonamido bond, a sulfonamido bond, a ureido bond, an ester bond, a carbonyl bond, an imido bond, a carbamoyl bond, a sulfamoyl bond, or the like.

As the ballast group, there are illustrated an alkyl group, an alkoxyalkyl group, an alkenyl group, an alkyl-substituted aryl group, an alkoxy-substituted aryl group, a terphenyl group, etc. These ballast groups may be substituted by a halogen atom (e.g., a fluorine atom, a chlorine atom, etc.), a nitro group, an amino group, a cyano group, an alkoxycarbonyl group, an aryloxycarbonyl group, an amido group, a carbamoyl group, a sulfamoyl group, a ureido group, a sulfonamido group, or the like. Specific examples of the ballast group include a 2-ethylhexyl group, a tert-octyl group, an n-dodecyl group, a 2,2-dimethyldodecyl group, an n-octadecyl group, a 2-(n-hexyl)decyl group, a 9,10-dichlorooctadecyl group, a 2,4-di-tert-amylcyclohexyl group, a dodecyloxypropyl group, an oleyl group, a 2,4-di-tert-amylphenyl group, a 2,4-di-tert-amyl-6-chlorophenyl group, a 3-n-pentadecylphenyl group, a 2-dodecyloxyphenyl group, a 3-heptadecyloxyphenyl group, an o-terphenyl group, a perfluoroheptyl group, etc.

A specific and suitable manner of dispersing the above-described diffusion-resistant couplers in a photographic emulsion is described in detail in U.S. Pat. No. 3,676,131. An organic solvent having low solubility in water, a high boiling point, and compatible with the couplers in a color light-sensitive material such as substituted hydrocarbons, carboxylic acid esters, carboxylic acid amides, phosphoric acid esters, and ethers may be used to disperse the couplers. Specific examples thereof include di-n-butyl phthalate, diisooctyl acetate, di-n-butyl sebacate, tricresyl phosphate, tri-n-hexyl phosphate, tricyclohexyl phosphate, N,N-diethylcaprylamide, butyl-n-pentadecylphenyl ether, chlorinated paraffin, butyl benzoate, pentyl o-methylbenzoate, propyl 2,4-dichlorobenzoate, etc. It is advantageous to use, in addition to the above-described high boiling solvents, an auxiliary solvent which helps dissolve the couplers and which can be removed during the production of light-sensitive materials. Examples of such auxiliary solvent include propylene carbonate, ethyl acetate, butyl acetate, cyclohexanol, tetrahydrofuran, cyclohexanone, etc.

The use of a surface active agent is advantageous to assist finely dispersing these oil-soluble couplers in a hydrophilic high molecular material to be used in a photographic emulsion. In particular, anionic surface active agents such as sodium cetylsulfate, sodium p-dodecylbenzenesulfonate, sodium nonylnaphthalenesulfonate, sodium di(2-ethylhexyl)-$\alpha$-sulfosuccinate, etc., and nonionic surface active agents such as sorbitan sesquioleic acid ester, sorbitan monolauric acid ester, etc., are suitable.

A homogenizer for an emulsion, colloid mill, ultrasonic wave emulsifier, and the like are useful for dispersing the oil-soluble couplers.

Examples of silver halide light-sensitive materials in which the coupler of the present invention can be used include color negative films, color positive films, color reversal films, color papers and other color photographic products for general use. Further, the couplers of the present invention can be used in color direct positive products, monochromatic products, color radiographic products, etc.

The couplers of the present invention can be used in multilayer color photographic materials of the conventional type (e.g., those described in U.S. Pat. Nos. 3,726,681, 3,516,831, British Pat. No. 923,045, etc.), in the processes set forth in Japanese Patent Application (OPI) No. 5179/75, and also in the methods disclosed in German Patent Application (OLS) No. 2,322,165 and U.S. Pat. No. 3,703,375 in which they are used in combination with a DIR compound.

The amount of the coupler used is generally in the range of from 1 to 1,500 g per mol of silver halide, which, however, can be changed according to the specific end-uses.

Silver halide photographic materials of the present invention comprise a support and various coatings thereon, such as a silver halide emulsion layer, an intermediate layer, an antihalation layer, a protective layer, a yellow filter layer, a backing layer, a mordanting polymer layer, a layer for preventing stains by the developer, etc. The silver halide emulsion layers for color photography comprise a red sensitive silver halide emulsion layer, a green sensitive silver halide emulsion layer and a blue sensitive silver halide emulsion layer. There is no particular limitation on the layer arrangement thereof, and further each of these layers may be divided into two or more layers.

From the point of view of obtaining increased stability of color photographic pictures, it is advantageous for the light-sensitive material of the present invention to contain a p-substituted phenol derivative in an emulsion layer or a neighboring layer. Particularly preferred p-substituted phenol derivatives can be selected from among hydroquinone derivatives described in U.S. Pat. Nos. 2,360,290, 2,418,613, 2,675,314, 2,701,197, 2,704,713, 2,710,801, 2,728,659, 2,732,300, 2,735,765, 2,816,028, etc.; gallic acid derivatives as described in U.S. Pat. Nos. 3,457,097, 3,069,262, and Japanese Patent Publication No. 13496/68; p-alkoxyphenols as described in U.S. Pat. No. 2,735,765 and Japanese Patent Application (OPI) No. 4738/72; and p-hydroxyphenol derivatives as described in U.S. Pat. Nos. 3,432,300, 3,573,050, 3,574,627 and 3,764,337.

The light-sensitive material used in the present invention advantageously contains an ultraviolet ray absorbent described in, for example, U.S. Pat. Nos. 3,250,617, 3,253,921, etc., in an emulsion layer or a neighboring layer for stabilizing images.

The silver halide emulsion and other layers can be hardened using any conventionally known methods employing aldehyde compounds such as formaldehyde, glutaraldehyde, etc., ketone compounds, such as diacetyl or cyclopentanedione, compounds having a reactive halogen, such as bis(2-chloroethylurea), 2-hydroxy-4,6-dichloro-1,3,5-triazine, and those described in U.S. Pat. Nos. 3,288,775, 2,732,303, 3,125,449 and 1,167,207, compounds having a reactive olefinic group, such as divinyl sulfone, 5-acetyl-1,3-diacryloylhexahydro-1,3,5-triazine, and those set forth in U.S. Pat. Nos. 3,635,718 and 3,232,763, British Pat. No. 994,869, etc. N-methylol compounds, such as N-hydroxymethyl phthalimide and those set forth in U.S. Pat. Nos. 2,732,316 and 2,586,168, etc., isocyanate compounds disclosed in U.S. Pat. No. 3,103,437, aziridine compounds set forth in U.S. Pat. Nos. 3,017,280 and 3,983,611, etc., acid derivatives described in U.S. Pat. Nos. 2,725,294 and 2,725,295, etc., carbodiimide derivatives such as those described in U.S. Pat. No. 3,100,702, etc., epoxy compounds set forth in, for example, U.S. Pat. No. 3,091,537, isoxazoles disclosed in U.S. Pat. Nos. 3,321,313 and 3,543,292, halocarboxyaldehyde compounds including mucochloric acid, dioxane derivatives such as dihydroxydioxane, dichlorodioxane, etc., or inorganic hardening agents such as chrome alum, zirconium sulfate, etc.

Precursors of hardening agents can also be used with examples of such precursors including alkali metal bisulfite/aldehyde adducts, the methylol derivative of hydantoin, primary aliphatic nitro alcohols, etc.

The color photographic material of the present invention can be subjected to conventional and well known processing comprising, after exposure, color development, bleaching and fixing. Each processing step may be combined with another using a processing agent capable of accomplishing the corresponding functions. A typical example of such a combined processing is a mono-bath process using a blix solution.

Depending on the requirements, the development processing can include additional steps such as prehardening, neutralization, primary development (black-and-white development), image stabilization, washing with water, etc. The processing temperature, which is determined depending on the kind of photographic material as well as by the processing composition, is sometimes below about 18° C. but, in most cases, is not lower than 18° C.

A particularly useful temperature range is from about 20° to 60° C. The temperature may be varied from one processing step to another in the processing.

A color developer comprises an aqueous alkaline solution with a pH not lower than about 8, and more preferably between 9 and 12, containing a color developing agent the oxidation product of which is capable of reacting with a coupler to form a dye.

Suitable color developing agents which can be used include, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfamidoethyl-N,N-diethylaniline, and the salts thereof, such as the sulfates, the hydrochlorides, the sulfites, the p-toluenesulfonates, etc. Other color developing agents which can be used are described in U.S. Pat. Nos. 2,592,364 and 2,193,015, Japanese Patent Application (OPI) No. 64933/73, L. F. A. Mason, *Photographic Processing Chemistry*, pp. 226–229, Focal Press, London (1966), etc.

Each of the above-described compounds can be used in conjunction with 3-pyrazolidone derivatives. Further, a number of additives well known in the art may be present in the color developer.

The coupler of this invention can also be incorporated into the color developer and a suitable amount of the coupler of this invention which can be used in the color developing solution is about 0.5 to 20 g per liter of the developing solution.

The photographic material of the present invention is subjected to bleaching after color development. This step may be combined with fixing, whereby the processing solution contains a fixing agent in addition to a bleaching agent.

Suitable bleaching agents include ferricyanide salts, bichromate salts, water-soluble cobalt (III) salts, water-soluble copper (II) salts, water-soluble quinones, nitrosophenol, polyvalent metal compounds containing Fe (III), Co (III), Cu (II), with complex salts of such metals with organic acids, such as, for example, ethylenediamine tetraacetic acid, nitrilotriacetic acid, imidoacetic acid, N-hydroxyethylethylenediamine triacetic acid and other aminopolycarboxylic acid, malonic acid, tartaric acid, malic acid, diglycolic acid, dithioglycolic acid and 2,6-dipicolic acid copper complex salt, etc., being particularly preferred, peracids, such as alkyl peracids, persulfates, permanganates, hydrogen peroxide, etc., hypochlorites, etc.

Other additives, such as bleach accelerating agents as disclosed in U.S. Pat. Nos. 3,043,520 and 3,241,966, Japanese Patent Publication Nos. 8506/70 and 8836/70, etc., can be further added to the bleaching solution.

The couplers in accordance with the present invention can also be used for low silver content light-sensitive materials containing silver in an emulsion in about 1% to about 50% amount as compared with ordinary light-sensitive materials. With respect to such color light-sensitive materials containing a reduced amount of silver halide, sufficient color images can be obtained according to an image-forming process of increasing the amount of dye to be produced utilizing color intensification using a peroxide or a cobalt complex salt (described in, for example, West German Patent Application (OLS) No. 2,357,694, U.S. Pat. Nos. 3,674,490, 3,761,265, West German Patent Application (OLS) Nos. 2,044,833, 2,056,359, 2,056,360, 2,226,770, Japanese Patent Application (OPI) Nos. 9728/73, 9729/73, etc.).

The present invention will now be described in more detail by reference to examples which, however, do not limit the present invention in any way.

EXAMPLE 1

10 ml of di-n-butyl phthalate and 20 ml of ethyl acetate were added to 10 g of foregoing coupler (2), or 1-hydroxy-4-(β-hydroxyethoxy)-N-n-hexadecyl-2-naphthamide and dissolved by heating to 50° C. The resulting solution was added to 10 ml of an aqueous solution containing 10 g of gelatin and 0.5 g of sodium p-dodecylbenzenesulfonate, and subjected to vigorous mechanical stirring for 20 minutes using a high speed agitator to thereby finely emulsify and disperse the coupler together with the solvent. (The resulting emulsion was referred to as emulsion dispersion (A)).

53.1 g of this fine emulsion dispersion was added to 100 g of a photographic emulsion containing 0.03 mol of silver chlorobromide (AgBr: 50 mol%) and 8 g of gelatin, and 12 ml of a 2% aqueous solution of 2-hydroxy-4,6-dichloro-s-triazine sodium salt was added thereto as a hardener. Then, the pH was adjusted to 6.5, and the resulting emulsion was coated on a cellulose triacetate film base in a coated silver amount of $8.5\times10^{-3}$ mol/m$^2$ to prepare a photographic light-sensitive material, which was called sample A. The coupler content in sample A was $2.16\times10^{-3}$ mol/m$^2$.

Then, in a manner analogous to the above-described process for emulsion dispersion (A) except using 10 g of couplers (6) and (38), there were prepared emulsion dispersions (B) and (C), respectively. Photographic light-sensitive materials were prepared in the same manner as with sample A using the same emulsion except for adding 58.1 g of emulsion dispersion (B) and 59.7 g of emulsion dispersion (C), respectively. The resulting two samples were referred to as samples B and C, respectively.

As comparative samples, photographic light-sensitive materials (samples D and E) were prepared in the same manner as with sample A except for using 10 g of 1-hydroxy-4-chloro-N-n-hexadecyl-2-naphthamide (coupler a) and 10 g of 1-hydroxy-4-tetradecyloxy-N-n-hexadecyl-2-naphthamide (coupler b), respectively, and adding 50.5 g and 70.3 g of the emulsion dispersion, respectively.

Coupler contents in these samples B, C, D and E were $2.15\times10^{-3}$ mol/m$^2$, $2.14\times10^{-3}$ mol/m$^2$, $2.16\times10^{-3}$ mol/m$^2$, and $2.17\times10^{-3}$ mol/m$^2$, respectively.

These photographic light-sensitive materials were subjected to stepwise exposure for sensitometry, then to the following processings in order.

| | Temperature (°C.) | Time (minute) |
|---|---|---|
| 1. Color development | 24 | 8 |
| 2. Washing with water | " | 1 |
| 3. First fixing | " | 4 |
| 4. Washing with water | " | 3 |
| 5. Bleaching | " | 6 |
| 6. Washing with water | " | 3 |
| 7. Second fixing | " | 4 |
| 8. Washing with water | " | 10 |

The composition of the color developer used in the above-described color development processing was as follows.

| Color Developer | |
|---|---|
| Anhydrous Sodium Sulfite | 3.0 g |
| 4-Amino-3-methyl-N,N-diethylaniline Hydrochloride | 2.5 g |
| Sodium Carbonate (monohydrate) | 47.0 g |
| Potassium Bromide | 2.0 g |
| Water to make | 1,000 ml |

The fixing solution and the bleaching solution had the following compositions, respectively.

| Fixing Solution (first and second fixing solutions) | |
|---|---|
| Sodium Thiosulfate | 150 g |
| Sodium Sulfite | 15 g |
| Clacial Acetic Acid (28% aq. soln.) | 48 ml |
| Boric Acid | 7.5 g |
| Water to make | 1,000 ml |
| Bleaching Solution | |
| Potassium Bromide | 20 g |
| Red Prussiate of Potash | 100 g |
| Glacial Acetic Acid | 20 ml |
| Sodium Acetate | 40 g |
| Water to make | 1,000 ml |

After the above-described processings, optical densities of these samples A, B, C, D and E for red light were measured to obtain the results tabulated in Table 1.

TABLE 1

| Film Sample | Coupler | Amount of Coupler | Fog | Sensitivity* (relative value) | Gamma | Maximum Density |
|---|---|---|---|---|---|---|
| A | (2) | $2.16\times10^{-3}$ | 0.05 | 94 | 3.32 | 3.51 |
| B | (6) | $2.15\times10^{-3}$ | 0.05 | 98 | 3.41 | 3.60 |
| C | (38) | $2.14\times10^{-3}$ | 0.06 | 100 | 3.47 | 3.65 |
| D | (a) | $2.16\times10^{-3}$ | 0.05 | 85 | 2.25 | 3.24 |
| E | (b) | $2.17\times10^{-3}$ | 0.04 | 71 | 1.69 | 2.20 |

*Relative values of reciprocals of exposure amounts necessary to obtain a density of fog + 0.1.

Separately, samples A, B, C, D and E were processed changing the time of the color development processing, the maximum densities for red light were measured to obtain the results shown in Table 2.

TABLE 2

| Film Sample | Coupler | Developing Time (minutes) 4 | 8 | 15 |
|---|---|---|---|---|
| A | (2)* | 3.41 | 3.51 | 3.53 |
| B | (6)* | 3.52 | 3.60 | 3.60 |
| C | (38)* | 3.60 | 3.65 | 3.65 |
| D | (a)** | 3.01 | 3.24 | 3.34 |
| E | (b)** | 1.97 | 2.20 | 2.41 |

*Present invention
**Comparative coupler

These results show that as compared with coupler (a) wherein an active site is substituted by a chlorine atom and coupler (b) wherein an active site is substituted by a tetradecyloxy group used in the comparative samples the couplers of the present invention provide a high sensitivity, high gradation, and high color density, and they provide enough coloration in such a short time that the processing time can be shortened. In order to more clearly show the improved coupling reactivity, the following experiments were conducted.

Samples obtained in the same manner as with sample A using, respectively, mixtures prepared by mixing couplers (2), (6), (38) of the present invention, coupler (a) and coupler (b) with a yellow color-forming coupler (c), α-(4-methoxybenzoyl)-2-chloro-5-[α-(2',4'-di-tert-amylphenoxy)butyramido]acetanilide, in a molar ratio of 1:2 were subjected to the action of a color developing agent of 4-amino-3-methyl-N,N-diethylaniline to competitively form color. The relative reaction rate constants of the coupling reaction of the couplers of the present invention based on yellow color-forming coupler (c) were calculated by analyzing the ratio of the amount of the yellow dye to that of the cyan dye formed.

Coupling reactivity of the coupler can be determined as a relative value by adding in combination two couplers M and N providing dyes distinctly discriminatable from each other to an emulsion, and measuring each of the amounts of dyes obtained by color-developing the emulsion.

Suppose that coupler M provides a maximum density of $(DM)_{max}$ and a medium density of DM, and that coupler N provides $(DN)_{max}$ and DN, respectively. Then, the reactivity ratio of the two couplers, RM/RN, can be represented by the following formula:

$$\frac{RM}{RN} = \frac{\log\left(1 - \frac{DM}{(DM)_{max}}\right)}{\log\left(1 - \frac{DN}{(DN)_{max}}\right)}$$

That is, the coupling reactivity ratio, RM/RN, can be determined from the slope of a straight line obtained by plotting several sets of DM and DN, obtained by stepwise exposing the emulsion containing mixed couplers and development processing on two rectangular coordinate axes as $$\log\left(1 - \frac{D}{D_{max}}\right)$$

As a result, it was found that relative reaction rate constants of couplers of the present invention (2), (6) and (38) were 1.7, 1.9, and 2.0, respectively, whereas that of conventionally known coupler (a) substituted by a chlorine atom in an active site was 1.2 and that of tetradecyloxy-substituted coupler (b) was 0.8. Thus, it is clearly demonstrated that the couplers of the present invention have an improved reactivity and are excellent couplers.

EXAMPLE 2

To 10 g of coupler (3), or 1-hydroxy-4-(β-hydroxyethoxy)-N-[γ-(2,4-di-tert-amylphenoxy)propyl]-2-naphthamide, were added 10 ml of tricresyl phosphate, 20 ml of ethyl acetate, and 0.5 g of sodium di(2-ethylhexyl)-α-sulfosuccinate and, after heating to 50° C. to dissolve, the mixture was added to 100 ml of an aqueous solution containing 10 g of gelatin, then finely emulsified and dispersed using a homogenizer to obtain emulsion dispersion (F).

37.6 g of this fine emulsion dispersion was added to 100 g of a silver bromoiodide emulsion (gelatin content; 6 g) containing 7 mol% iodide and $3.5\times10^{-2}$ mol silver. Then, to the resulting mixture was added 5 ml of a 2% methanol solution of 6-methyl-4-hydroxy-1,3,3a,7-tetrazaindene and 6.5 ml of a 2% aqueous solution of 2-hydroxy-4,6-dichloro-s-triazine sodium salt (as a hardener) and, finally, the pH was adjusted to 6.5. The resulting mixture was coated on a cellulose triacetate base in a coated coupler amount of $2.05\times10^{-3}$ mol/m$^2$ to obtain sample (F).

Then, coupler (7), comparative coupler (h) having the same mother nucleus structure as that of coupler (1) and having no substituent at the active site, coupler (i) substituted by a chlorine atom at the active site, coupler (j) substituted by an ethoxy group at the active site, coupler (k) substituted by a butylcarbamylmethoxy group at the active site, coupler (l) or 1-hydroxy-4-benzylaminocarbonylmethoxy-N-[δ-(3-n-dodecyloxyphenoxy)butyl]-2-naphthamide, and coupler (p) or 1-hydroxy-4-(2-bromoethoxy)-N-[δ-(2,4-di-tert-amylphenoxy)butyl]-2-naphthamide were used and, in the same manner as with emulsion dispersion (F), emulsion dispersions (G), (H), (I), (J), (K), (L) and (P) corresponding to coupler (7), couplers (h), (i), (j), (k), (l) and (p), respectively were prepared. Then, there were prepared samples G, H, I, J, K, L, and P containing 39.6 g of emulsion dispersion (G) and 100 g of the same emulsion as use in sample F, 32.4 g of emulsion dispersion (H) and 200 g of the same emulsion, 34.7 g of emulsion dispersion (I) and 100 g of the emulsion, 35.0 g of emulsion dispersion (J) and 100 g of the emulsion, 41.3 g of emulsion dispersion (K) and 100 g of the emulsion, 50.0 g of emulsion dispersion (L) and 100 g of the emulsion, and 41.9 g of emulsion dispersion (P) and 100 g of the emulsion, respectively.

The coupler contents in these seven samples were $2.06\times10^{-3}$ mol/m$^2$, $2.07\times10^{-3}$ mol/m$^2$, $2.05\times10^{-3}$ mol/m$^2$, $2.07\times10^{-3}$ mol/m$^2$, $2.07\times10^{-3}$ mol/m$^2$, $2.05\times10^{-3}$ mol/m$^2$, and $2.06\times10^{-3}$ mol/m$^2$, respectively.

These seven samples were stepwise exposed for sensitometry, then subjectd to the following processings.

| Processing Step | Temperature (°C.) | Time (minute) |
|---|---|---|
| 1. Color development | 38 | 3 |
| 2. Stopping | " | 1 |
| 3. Washing with water | " | 1 |
| 4. Bleaching | " | 2 |
| 5. Washing with water | " | 1 |
| 6. Fixing | " | 2 |
| 7. Washing | " | 1 |

-continued

| Processing Step | Temperature (°C.) | Time (minute) |
|---|---|---|
| 8. Stabilizing | " | 1 |

Each of the processing solutions used had the following composition.

| | |
|---|---|
| Color Developer | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Disodium Ethylenediaminetetraacetate Dihydrate | 2 g |
| 4-Amino-3-methyl-N-ethyl-N-(β-hydroxyethyl)aniline Monosulfate | 4 g |
| Water to make | 1,000 ml |
| Stopping Bath | |
| Sodium Thiosulfate | 10 g |
| Ammonium Thiosulfate (70% aq. soln.) | 30 ml |
| Acetic Acid | 30 ml |
| Sodium Acetate | 5 g |
| Potash Alum | 15 g |
| Water to make | 1,000 ml |
| Bleaching Solution | |
| Iron (III) Sodium Ethylenediamine-tetraacetate Dihydrate | 100 g |
| Potassium Bromide | 50 g |
| Ammomium Nitrate | 50 g |
| Boric Acid | 5 g |
| | Aqueous Ammonia to adjust pH to 5.0 |
| Water to make | 1,000 ml |
| Fixing Solution | |
| Sodium Thiosulfate | 150 g |
| Sodium Sulfite | 15 g |
| Borax | 12 g |
| Glacial Acetic Acid | 15 ml |
| Potash Alum | 20 g |
| Water to make | 1,000 ml |
| Stabilizing Bath | |
| Boric Acid | 5 g |
| Sodium Citrate | 5 g |
| Sodium Metaborate Tetrahydrate | 3 g |
| Potash Alum | 15 g |
| Water to make | 1,000 ml |

After the above-described processings, optical densities of these samples F, G, H, I, J, K, L and P for red light were measured to obtain the results shown in Table 3.

TABLE 3

| Film Sample | Coupler | Amount of Coupler (mol/m²) | Fog | Sensitivity[1] (relative values) | Gamma | maximum Density |
|---|---|---|---|---|---|---|
| F | (1)* | $2.05 \times 10^{-3}$ | 0.07 | 98 | 2.63 | 2.91 |
| G | (7)* | $2.06 \times 10^{-3}$ | 0.07 | 100 | 2.70 | 3.00 |
| H | (h)** | $2.07 \times 10^{-3}$ | 0.06 | 71 | 1.67 | 2.24 |
| I | (i)** | $2.05 \times 10^{-3}$ | 0.06 | 73 | 1.71 | 2.26 |
| J | (j)** | $2.07 \times 10^{-3}$ | 0.07 | 77 | 1.84 | 2.03 |
| K | (k)** | $2.07 \times 10^{-3}$ | 0.06 | 73 | 1.84 | 2.38 |
| L | (l)** | $2.05 \times 10^{-3}$ | 0.07 | 78 | 1.90 | 2.31 |
| P | (p)** | $2.06 \times 10^{-3}$ | 0.06 | 75 | 1.82 | 2.25 |

[1]Relative values of reciprocals of exposure amounts necessary for obtaining a density of fog + 0.1.
*Present invention
**Comparative coupler From the above results, it is seen that, as compared with the couplers used for the comparative samples, i.e., active site-non-substituted coupler (h), coupler (i) substituted by a chlorine atom at the active site, coupler (j) substituted by an ethoxy group at the active site, coupler (k) substituted by a butylcarbamylmethoxy group at the active site, coupler (l) or 1-hydroxy-4-benzylaminocarbonylmethoxy-N-[δ-(3-n-dodecyloxyphenoxy)butyl]-2-naphthamide, and coupler (p) or 1-hydroxy-4-(2-bromoethoxy)-N-[δ-(2,4-di-tert-amylphenoxy)butyl]-A2-naphthamide, couplers of the present invention (1) and (7) provided a higher sensitivity, higher gradation, and higher maximum density. Further, a microscopic survey did not reveal reduction in graininess of colored images due to an increase in coupling activity.

EXAMPLE 3

35.6 g of coupler (8), or 1-hydroxy-4-{β-[β'-(β''-hydroxy)ethoxy]ethoxy}-N-n-hexadecyl-2-naphthamide, 40 ml of di-n-butyl phthalate, 80 ml of ethyl acetate, and 2.0 g of sodium di(2-ethylhexyl)-α-sulfosuccinate were mixed and heated to 50° C. to dissolve. The resulting solution was added to 400 ml of an aqueous solution containing 40 g of gelatin, and the thus-obtained emulsion was further finely emulsified and dispersed using a homogenizer.

An emulsion to be used was prepared by adding as a red sensitive dye 200 ml of a 0.01% methanol solution of compound I described in U.S. Pat. No. 3,635,721 to 1.0 kg of a silver chlorobromide emulsion containing 50 mol% bromide, 0.3 ml silver, and 70 g gelatin, then adding thereto 50 ml of a 1% methanol solution of 6-methyl-4-hydroxy-1,3,3a,7-tetrazaindene.

To this emulsion was added the whole amount of the above-described emulsion dispersion, and 30 ml of a 3% acetone solution of triethylenephosphamide was added thereto as a hardener. Finally, the pH was adjusted to 6.5 to prepare a red sensitive silver halide emulsion.

On a support of baryta paper resin-treated on both sides with polyethylene were coated, as a first layer, a blue-sensitive silver halide emulsion containing coupler (m) or α-(5,5-dimethyl-2,4-dioxooxazolidin-3-yl)-α-pivaloyl-2-chloro-5-[α-(2',4'-di-tert-amylphenoxy)-butyramido]acetanilide in a dry thickness of 4.0μ and, as a second layer, a gelatin solution in a dry thickness of 1.0μ and, as a third layer, a green-sensitive silver halide emulsion containing coupler (n) or 1-(2,4,6-trichlorophenyl)-3-[(2-chloro-5-n-tetradecanamide)anilino]-5-pyrazolone in a dry thickness of 2.5μ. As a fourth layer, a gelatin solution containing 2-(2'-benzotriazolyl)-4,6-dibutylphenol as an ultraviolet ray absorbent was coated thereon in a dry thickness of 2.5μ. As a fifth layer, the aforesaid red-sensitive silver halide emulsion was coated in a dry thickness of 3.5μ. Further, as an uppermost layer, a gelatin solution was coated thereon in a dry thickness of 0.5μ to prepare a color photographic paper.

A color negative image was optically printed on this color photographic paper followed by subjecting the paper to the following processings.

| Processing Step | Temperature (°C.) | Time (minute) |
|---|---|---|
| 1. Color development | 30 | 6 |
| 2. Stopping | " | 2 |
| 3. Washing with water | " | 2 |
| 4. Bleach-fixing | " | 2 |
| 5 Washing with water | " | 2 |

-continued

| Processing Step | Temperature (°C.) | Time (minute) |
|---|---|---|
| 6. Stabilizing bath | " | 2 |

Each of the processing solutions used had the following composition.

| | |
|---|---|
| Color Developer | |
| Benzyl Alcohol | 12 ml |
| Diethylene Glycol | 3.5 ml |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfate | 2.0 g |
| Disodium Ethylenediaminetetraacetate Dihydrate | 2.0 g |
| 4-Amino-3-methyl-N-ethyl-N-(β-methanesulfonamidoethyl)aniline Sesquisulfate Monohydrate | 5.0 ml |
| Water to make | 1,000 ml |
| Stopping Solution | |
| Sodium Thiosulfate | 10 g |
| Ammonium Thiosulfate (70%) | 30 ml |
| Sodium Acetate | 5 g |
| Acetic Acid | 30 ml |
| Potash Alum | 15 g |
| Water to make | 1,000 ml |
| Bleach-Fixing Solution | |
| Ferric Sulfate | 20 g |
| Disodium Ethylenediaminetetraacetate Dihydrate | 36 g |
| Sodium Carbonate Monohydrate | 17 g |
| Sodium Sulfite | 5 g |
| Ammonium Thiosulfate (70%) | 100 ml |
| Boric Acid (to adjust pH to 6.8) | 5 g |
| Water to make | 1,000 ml |
| Stabilizing Solution | |
| Boric Acid | 5 g |
| Sodium Citrate | 5 g |
| Sodium Metaborate (tetrahydrate) | 3 g |
| Potash Alum | 15 g |
| Water to make | 1,000 ml |

The thus-obtained color print showed an excellent color-reproducing ability with distinct colors. The cyan dye image had an absorption maximum at 710 mμ.

When this color print was irradiated for 20 days under the condition of 30,000 luxes in illuminance using a white fluorescent lamp, a density reduction in the area where initial reflection density of the cyan dye image was 1.0 was 0.03. When it was left for 10 days under the high temperature and high humidity conditiions of 60° C. and 75% in relative humidity, a density reduction in the area where initial reflection density was 1.0 was 0.07. Thus, it showed a good color image stability.

Also, when one unexposed coated sample was left for 3 days under the conditions of 40° C. and 80% RH and the other for the same days under the conditions of 25° C. and 60% RH and, after stepwise exposure for sensitometry, and two samples were simultaneously subjected to the above-described processings, there were observed no changes in photographic characteristics such as maximum density, fog, gamma, etc., in spite of being left under severe conditions. Thus, the light-sensitive material was revealed to be stable.

EXAMPLE 4

10 g of coupler (15) of the present invention, or N-n-hexadecyl-N-cyanoethyl-1-hydroxy-4-(β-ethoxyethoxy)-2-naphthamide, 10 ml of tris-n-hexyl phosphate, and 20 ml of ethyl acetate were heated to 50° C. to dissolve, and the resulting solution was added to 100 ml of an aqueous solution containing 0.5 g of sodium p-dodecylbenzenesulfonate and 10 g of gelatin, and stirred followed by vigorous mechanical stirring to thereby emulsify and disperse the coupler together with the solvent.

The whole of this emulsion dispersion was added to 186 g of a reversal silver bromoiodide emulsion (containing $8.37\times10^{-2}$ mol Ag and 13.0 g gelatin) containing 3 mol% iodide, and 12 ml of a 4% aqueous solution of 2-hydroxy-4,6-dichloro-s-triazine sodium salt was added thereto as a hardener. Finally, the pH was adjusted to 7.0, and the thus-obtained emulsion was coated on a polyethylene terephthalate film base in a coated silver amount of 0.90 g/m$^2$.

This sample was stepwise exposed for sensitometry, and subjected to the following processings.

| Processing Step | Temperature (°C.) | Time (minute) |
|---|---|---|
| 1. First development | 30 | 3 |
| 2. Washing with water | " | 0.5 |
| 3. Repeated exposure: | Uniform exposure of the emulsion surface in an exposure amount of 8,000 lux-sec. | |
| 4. Second development | 30 | 4 |
| 5. Washing with water | " | 1 |
| 6. Bleaching | " | 1 |
| 7. Washing with water | " | 0.5 |
| 8. Fixing | " | 1 |
| 9. Washing with water | " | 1 |

Each of the processing solutions used had the following composition.

| | |
|---|---|
| First Developer | |
| 4-(N-methylamino)phenol Sulfate | 2 g |
| Sodium Sulfite | 90 g |
| Hydroquinone | 8 g |
| Sodium Carbonate Monohydrate | 52.5 g |
| Potassium Bromide | 5 g |
| Potassium Thiocyanate | 1 g |
| Water to make | 1,000 ml |
| Second Developer | |
| Benzyl Alcohol | 5 ml |
| Sodium Sulfite | 5 g |
| Hydroxylamine Hydrochloride | 2 g |
| 4-Amino-3-methyl-N-ethyl-N-(β-ethoxyethyl)aniline p-toluenesulfonate | 3 g |
| Potassium Bromide | 1 g |
| Trisodium Phosphate | 30 g |
| Sodium Hydroxide | 0.5 g |
| Ethylenediamine (70% aq. soln.) | 7 ml |
| Water to make | 1,000 ml |
| Bleaching Solution | |
| Red Prussiate of Potash | 100 g |
| Sodium Acetate | 40 g |
| Sodium Sulfite | 20 g |
| Potash Alum | 30 g |
| Water to make | 1,000 ml |
| Fixing Solution | |
| Sodium Thiosulfate | 150 g |
| Sodium Acetate | 70 g |
| Sodium Sulfite | 10 g |
| Potash Alum | 20 g |
| Water to make | 1,000 ml |

The thus-obtained color reversal image had an absorption maximum at 687 mμ, and showed a good coloration.

Further, the same sample was left for three days under the conditions of 40° C. and 75% RH, stepwise exposed for sensitometry, and subjected to the above-described processings for comparison. There were observed no changes in photographic characteristics such as $D_{max}$, fog, gamma, sensitivity, etc. Thus, the coupler was revealed to show an excellent stability.

EXAMPLE 5

A silver bromoiodide emulsion containing 4 mol% iodide was coated on a film in a coated silver amount of 120 $\mu g/cm^2$ and in a thickness of 4.0$\mu$, and stepwise exposed for sensitometry followed by development processing at 27° C. for 4 minutes using the following color developer. Subsequent processings of washing, bleaching, washing, fixing, and washing were conducted according to Example 1 to obtain a cyan color image.

| Color Developer | |
|---|---|
| Sodium Sulfite | 5 g |
| 4-Amino-3-methyl-N,N-diethylaniline Hydrochloride | 0.6 g |
| Sodium Carbonate Monohydrate | 15 g |
| Potassium Bromide | 0.5 g |
| Potassium Iodide (0.1% aq. soln.) | 5 ml |
| Coupler (25), or 2-acetamido-6-chloro-4-($\beta$-methoxyethoxy)-5-methylphenol | 1.3 g |
| Methanol | 20 ml |
| Sodium Hydroxide | 2 g |
| Water to make | 1,000 ml |

This image was a distinct cyan color image having an absorption maximum at 672 m$\mu$.

While the invention has been described in detail and with reference to specific embodiments thereof, it will be apparent to one skilled in the art that various cahnges and modifications can be made therein without departing from the spirit and scope thereof.

What is claimed is:

1. A silver halide photographic light-sensitive material containing a colorless photographic cyan color-forming coupler having, in a position for coupling with an oxidation product of an aromatic primary amine developing agent, an eliminatable group represented by the following formula (I):

$$-O-(R_1O)_x(R_2O)_yR_3 \quad (I)$$

wherein $R_1$ and $R_2$ each represents a substituted or unsubstituted alkylene group which may be branched provided that $R_1$ is not substituted with an aryl group at the carbon atom adjacent to the oxygen atom bonded to the coupling position, $R_3$ represents a hydrogen atom, a substituted or unsubstituted alkyl group, a cycloalkyl group, an aryl group, or a cyan coupler residue, x represents a positive integer, and y represents 0 or a positive integer.

2. The light-sensitive material of claim 1, wherein $R_1$ and $R_2$ represents an alkylene group selected from a methylene group, a dimethylene group, a trimethylene group, a 2-methyldimethylene group, a 2-methyltrimethylene group and a propylene group.

3. The light-sensitive material of claim 2, wherein said alkylene group is substituted with a group selected from a nitro group, a hydroxy group, a sulfo group, an alkoxy group, and an aryl group.

4. The light-sensitive material of claim 1, wherein $R_3$ represents a hydrogen atom, a straight chain or branched alkyl group containing 1 to 18 carbon atoms, a cyclohexyl group, a cyclopentyl group, an aryl group containing 6 to 12 carbon atoms, or a cyan coupler residue.

5. The light-sensitive material of claim 1, wherein said coupler is represented by the formula:

$$A\text{-}[O-(R_1O)_x(R_2O)_yR_3]_n \quad (IA)$$

wherein $R_1$, $R_2$, $R_3$, x and y are defined as in claim 1, A represents a cyan color-forming coupler residue containing a naphtholic or phenolic nucleus and n is an integer corresponding to the number of coupling-active positions in the coupler residue.

6. The light-sensitive material of claim 1, wherein said coupler is represented by the formula:

$$A\text{-}[O-(R_1O)_x(R_2O)_yR_3]_n \quad (IA)$$

wherein $R_1$, $R_2$, $R_3$, x and y are defined as in claim 1, A represents a cyan color-forming coupler residue containing a naphtholic nucleus and n is an integer corresponding to the number of coupling-active positions in the coupler residue.

7. The light-sensitive material of claim 1, wherein said coupler is represented by the formula:

$$A-O-(R_1O)_x(R_2O)_yR_3]_n \quad (IA)$$

wherein $R_1$, $R_2$, $R_3$, x and y are defined as in claim 1, A represents a cyan color-forming coupler residue containing a phenolic nucleus and n is an integer corresponding to the number of coupling-active positions in the coupler residue.

8. The light-sensitive material of claim 5, wherein n is 1 or 2.

9. The light-sensitive material of claim 5, wherein x and y each is an integer of 1 to 10 and y may be 0.

10. The light-sensitive material of claim 5, wherein said coupler is represented by the formulae:

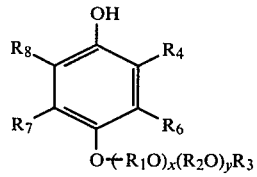

(IIA)

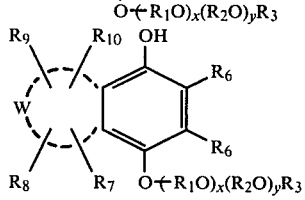

(IIB)

wherein $R_1$, $R_2$, $R_3$, x and y are defined as in claim 5, $R_4$ represents a hydrogen atom, an aliphatic group containing up to 30 carbon atoms, an alkoxy group, an aryloxy group, or a group represented by the following formulae:

$$-NH-CO-B \quad (III)$$

$$-NH-SO_2-B \quad (IV)$$

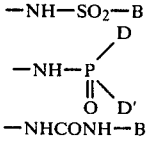

(V)

$$-NHCONH-B \quad (VI)$$

-continued $$-CONH-B \quad \text{(VII)}$$

$$-CON\begin{matrix} B \\ B' \end{matrix} \quad \text{(VIII)}$$

wherein B and B′ may be the same or different and each represents an aliphatic group containing up to 32 carbon atoms, or an aryl group both of which may be substituted, D and D′ each represents a B group or —OB, —NHB, and —$NB_2$, $R_5$ represents a hydrogen atom, an aliphatic group containing up to 30 carbon atoms, or a group represented by the above formula (VII) or (VIII), $R_6$, $R_7$, $R_8$, $R_9$ and $R_{10}$ each represents a hydrogen atom, a halogen atom, an alkyl group, an aryl group, an alkoxy group, an alkylthio group, a heterocyclic group, an amino group, a carbonamido group, a sulfonamido group, a sulfamyl group, or a carbamyl group, W represents the non-metallic atom necessary to complete a 5- or 6-membered carboxylic or heterocyclic ring.

11. The light-sensitive material of claim 10, wherein $R_1$ and $R_2$ each represents an alkylene group containing 1 to 4 carbon atoms, $R_3$ represents a hydrogen atom or a carboxy-substituted alkyl group, x and y represents integers of 1 to 4 and y may be 0.

12. The light-sensitive material of claim 11, wherein the sum of x and y is 2 to 8.

13. The light-sensitive material of claims 1, 5 or 10, wherein said coupler is present in a silver halide emulsion layer.

14. The light-sensitive material of claim 10, wherein said coupler is diffusion resistant and contains a $C_8$ to $C_{30}$ hydrophobic residue at one of the $R_1$–$R_{10}$ positions.

15. The light-sensitive material of claim 1, wherein said coupler is present in an amount of 1 to 1,500 g per mol of silver halide.

16. The light-sensitive material of claim 1, wherein said coupler is present in a layer adjacent a layer containing a p-substituted phenol derivative or in a layer containing a p-substituted phenol derivative.

17. The light-sensitive material of claim 1, wherein $R_3$ represents a hydrogen atom, a substituted or unsubstituted alkyl group, a cycloalkyl group, or an aryl group.

18. The light-sensitive material of claim 1, wherein $R_3$ is a hydrogen atom or an unsubstituted alkyl group.

19. The light-sensitive material of claim 1, wherein $R_1$ and $R_2$ are an alkylene group with 1 to 6 carbon atoms and $R_3$ is hydrogen or $C_1$ to $C_{18}$ alkyl.

20. The light-sensitive material of claim 19, wherein $R_3$ if alkyl is $CH_3$.

21. The light-sensitive material of claim 1, wherein said colorless photographic cyan color forming coupler comprises the moiety:

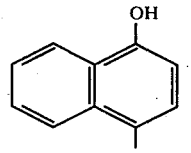

wherein the bond indicates the substitution point of said eliminatable group.

* * * * *